US006402231B1

(12) United States Patent
Pedemonte

(10) Patent No.: US 6,402,231 B1
(45) Date of Patent: Jun. 11, 2002

(54) MULTI-FUNCTION TRANSPORTABLE RECREATION CHAIR

(76) Inventor: G. Daniel Pedemonte, 1550 N. Lake Shore Dr., Apt. 26C, Chicago, IL (US) 60610

( * ) Notice: Subject to any disclaimer, the term of this patent is extended or adjusted under 35 U.S.C. 154(b) by 0 days.

(21) Appl. No.: 09/638,972

(22) Filed: Aug. 15, 2000

Related U.S. Application Data

(60) Provisional application No. 60/148,754, filed on Aug. 16, 1999.

(51) Int. Cl.[7] ..... A47C 4/04; A45F 4/02

(52) U.S. Cl. ..... 297/17; 297/129; 297/183.5; 297/188.13; 297/188.19; 224/155

(58) Field of Search ..... 297/17, 118, 129, 297/153, 183.5, 188.13, 188.14, 188.19, 188.01, 188.03, 188.04, 130; 224/155

(56) References Cited

U.S. PATENT DOCUMENTS

| | | | | | |
|---|---|---|---|---|---|
| 520,284 | A | * | 5/1894 | Wonson et al. | |
| 811,475 | A | * | 1/1906 | Bradley | 297/129 |
| 2,429,795 | A | * | 10/1947 | Blanchard et al. | 297/118 |
| 3,179,465 | A | * | 4/1965 | Roberts | 297/17 |
| 3,419,309 | A | * | 12/1968 | Smith | 297/17 |
| 3,544,157 | A | * | 12/1970 | Muller | 297/17 X |
| 3,822,422 | A | * | 7/1974 | Buntyn | 297/118 X |
| 4,339,061 | A | | 7/1982 | Dunn | |
| 4,376,547 | A | * | 3/1983 | Dominko | 297/118 X |
| 4,470,630 | A | | 9/1984 | Shields | |
| 4,514,009 | A | | 4/1985 | Vanderminden et al. | |
| 4,518,198 | A | * | 5/1985 | Daniels | 297/118 X |
| 4,676,548 | A | | 6/1987 | Bradbury | |
| 4,742,900 | A | * | 5/1988 | Boxhammer | 297/17 X |
| 4,863,003 | A | | 9/1989 | Carter | |
| 4,892,353 | A | | 1/1990 | Goddard | |
| 5,016,792 | A | * | 5/1991 | Jay | 297/17 X |
| 5,350,215 | A | | 9/1994 | DeMars | |
| 5,573,288 | A | * | 11/1996 | Raffensperger | 297/188.12 |
| 5,628,544 | A | * | 5/1997 | Goodman et al. | 297/17 X |
| 5,944,379 | A | * | 8/1999 | Yates | 297/17 X |
| 6,042,180 | A | * | 3/2000 | Lombardi | 297/188.11 |
| 6,145,716 | A | * | 11/2000 | Caicedo | 297/129 X |
| 6,206,463 | B1 | * | 3/2001 | Whigham | 297/129 |
| 6,244,481 | B1 | * | 6/2001 | Brougher | 297/118 X |
| 6,250,712 | B1 | * | 6/2001 | Livington et al. | 297/17 X |
| 6,264,078 | B1 | * | 7/2001 | Bilang | 297/129 X |

* cited by examiner

*Primary Examiner*—Robert Canfield
(74) *Attorney, Agent, or Firm*—Baniak Pine & Gannon

(57) ABSTRACT

A multi-function, transportable, recreation folding chair, includes a plurality of storage compartments therein. In a preferred form, the chair is a lightweight chaise-lounge arranged in a backpack for ready transport of both the chair and paraphernalia stored therein.

18 Claims, 7 Drawing Sheets

MULTI-FUNCTION TRANSPORTABLE RECREATION CHAIR

RELATED APPLICATIONS

This Application claims the benefit of U.S. Provisional Application 60/148,754, filed on Aug. 16, 1999.

FIELD OF THE INVENTION

The present invention relates to chairs and, in particular, to multi-function, transportable, recreation folding chairs, including those having storage containers built therein.

BACKGROUND OF THE INVENTION

Portable chairs for beach, picnicking, backpacking, parades and other outdoor uses have long been known. One of the more common uses for such a chair is at the beach. For instance, beach chairs have been constructed of a plurality of lightweight metallic tubular members with a fabric or plastic webbing being stretched across the members in order to form a seat section and a back section. Generally, these chairs are foldable from a collapsed position, typically with the intent of occupying a minimum amount of space and facilitating portability, to an extended position which causes the leg assembly to be extended from the back section assuming a substantially right angled position to the seat section. In the past, these types of chairs have been merely carried to the setting of use by grasping some handy part of the chair. Other paraphernalia would also be carried separately, such as a table, cooler, and the like.

As an improvement to this conventional beach type of chair, there have been some attempts at designing collapsible type of chairs which could be transported to the beach by being carried on one's back. Also, it has been known in the past to construct a beach chair which includes pouches which could be utilized to store articles, such as suntan oil, comb, brush and so forth. However, there is room for improvement in designing such chairs so that the chairs are of high quality and more durable construction, and are more quickly movable to the collapsed or retracted position and at the same time are quickly movable into the extended or usage position, and advantageously include necessary additional items usable by normal beach goers, and storage areas for the same.

SUMMARY OF THE INVENTION

The multi-function, transportable recreation chair of the present invention is an improvement over the art, providing in one form of the invention a compact chaise-lounge chair which can be backpacked or wheeled. In this form of the invention, it furthermore yields storage and stowage for over seven miscellaneous items when going out for many different types of recreational activities. For instance, when going to the beach or an outdoor event, a person may typically carry a chair, an umbrella, a cooler, drinks and/or food, a towel, reading materials, a headset, suntan lotion, etc. The chair of the present invention accomplishes the difficulty of carrying the above items in one easy-to-carry device.

The inventive chair in its form as a lounge chair in one preferred form provides a person with an adjustable recliner chair that has a footrest, two armrests that also act as thermal containers for hot or cold products or storage, a storage seat base that can accommodate a pad, a towel, books, magazines, laptop computers, etc. A tray table that provides a place to read, eat or use a laptop is a further modification. The chair of the present invention also has a storage compartment at the footrest and headrest that may accommodate an umbrella, sandals, shoes, etc.

One part of the foregoing preferred embodiment of the foot portion of the chair is also detachable to yield a table, if the chair is not to be used in its lounge chair mode.

The chair of this invention is most preferred in a backpack arrangement, with all of the parts folding into an area not much bigger in size than a large backpack. In this form, it is of a durable rigid construction, yet very lightweight and easy to transport, including within its various compartments much of the paraphernalia that one may wish to use, such as at the beach or any other outdoor activity. This preferred form of the invention advantageously uses interlocking hollow boxlike components, each of which comprises its own storage container.

BRIEF DESCRIPTION OF THE DRAWINGS

The above-mentioned and other features and advantages of this invention, and the manner of attaining them, will become more apparent and the invention will be further understood by reference to the following description of an embodiment of the invention taken in conjunction with the accompanying drawings, wherein:

FIG. 4*a* shows a modified version of the FIG. 4 embodiment;

FIG. 4*b* shows a detail of one embodiment of the hinge shown in FIG. 4*a;* and FIG. 5 illustrates a tray table for use in the multi-function transportable recreation chair of FIG. 1.

Figure 1:
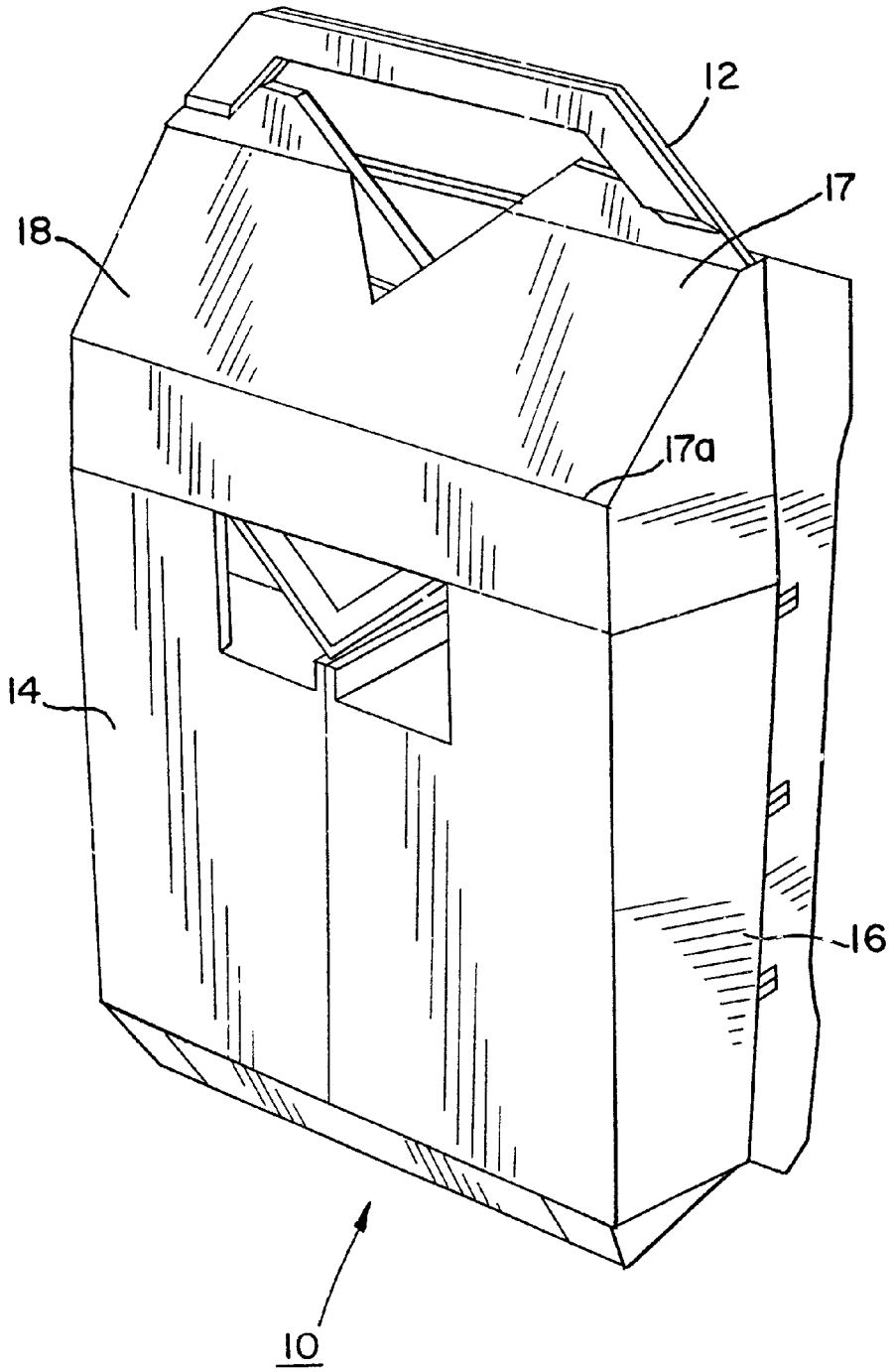
FIG. 1 shows a front perspective view of a multi-function transportable recreation chair, made in accordance with the present invention.

Corresponding reference characters indicate corresponding parts throughout the several views. What is illustrated is one preferred embodiment of the invention, in but one presently contemplated form, and such an illustrative example is not to be construed as limiting the scope of the invention in any manner, except as set forth in the claims.

DETAILED DESCRIPTION OF A PRESENTLY-PREFERRED EMBODIMENT

In broad overview, the present invention relates to a multi-function, transportable recreation chair. As described in the following embodiment, it has found one application as a beach chair. While it will be described in that particular environment, it will be understood that the invention has much broader application.

That being said, the chair may best be constructed of a custom-molded lightweight plastic material. It preferably includes retracting/removable support portions (i.e., chair legs), a folddown part to support the user's legs in a lounge chair form and a folddown part to support the user's back.

Furthermore, the seat portion of the chair advantageously includes a storage container, as does the back support. Additionally, the chair may include fold-out armrests disposed on the side of the chair. The armrests, like the seat portion, may also include storage containers. The storage containers may be constructed so as to insulate the objects therein (i.e., to keep foods or liquids warm or cold), as well as to keep the objects therein dry. Additionally, the storage container contained within the seat portion of the chair may be constructed to carry larger objects, such as, for example, an umbrella, a book, a laptop computer, magazines, etc.

The various parts of the chair itself are preferably designed to be folded together in an interlocking arrangement of boxlike components so as to easily transport the chair, such as, for example, as a backpack. It could also readily be adapted as a handcart, with wheels added to virtually the same backpack form.

Referring now to the drawings, there is shown a multifunction, transportable recreation chair 10. In FIG. 1, chair 10 is illustrated in a retracted stowage (i.e., transport) position. As shown in FIG. 1, chair 10 includes handle 12, first armrest portion 14, second armrest portion 16 and back portion 18. When in the transport position, chair 10 may be boxlike in shape. That is, chair 10 may take the form of any substantially rectangular device, including a box, a contoured device or any other similar geometric shape.

All of major components of the chair 10 are considered to preferably be constructed of molded high impact lightweight plastic. Other similar lightweight material may be used, of course, and not all of the major components need be made of the same material.

Figure 3:
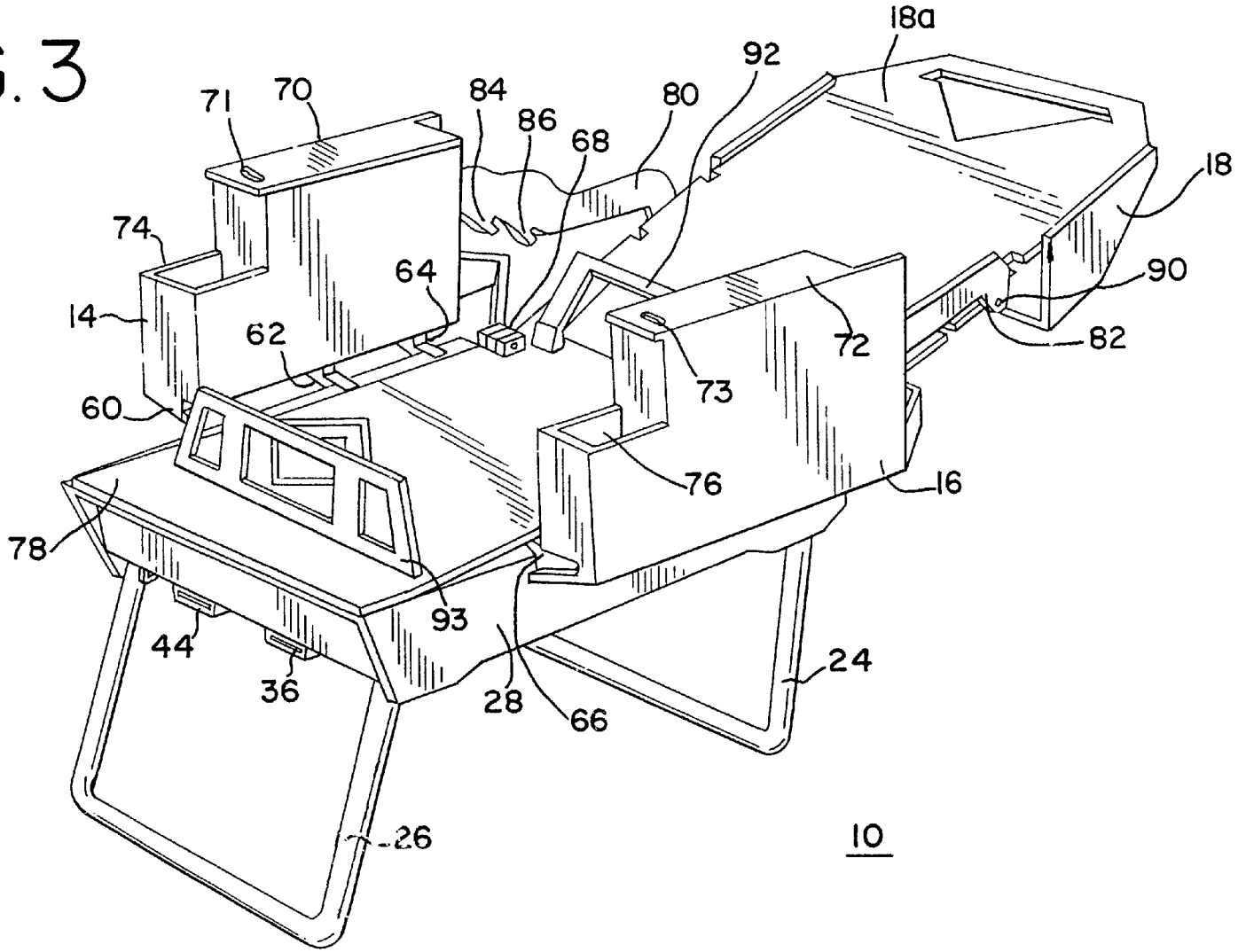
FIG. 3 shows one embodiment of a partially-open perspective view of the multi-function transportable recreation chair of FIG. 1.
Figure 4:
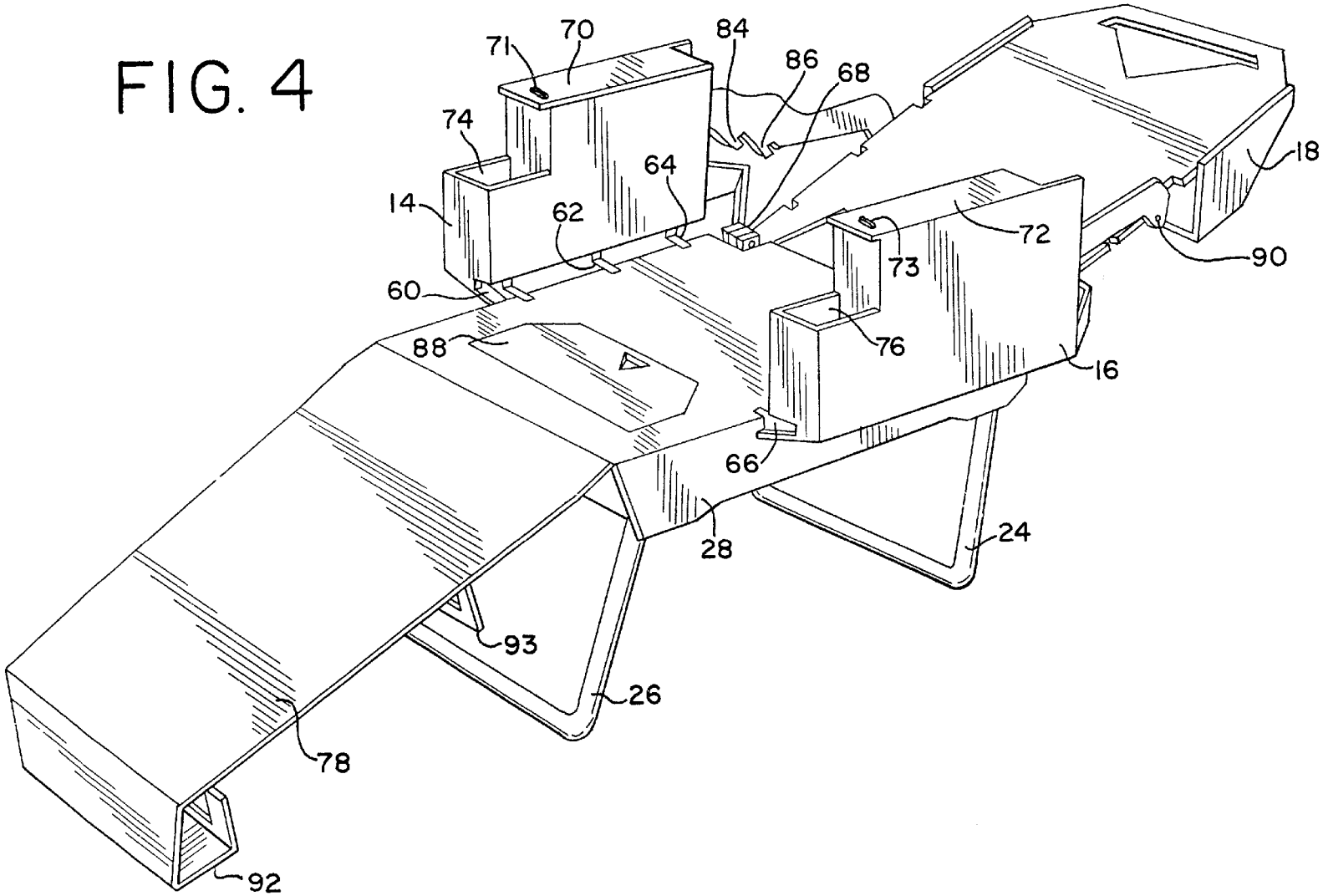
FIG. 4 shows one embodiment of a fully-open perspective view of the multi-function transportable recreation chair of FIG. 1.

Back portion 18 may be contoured to fit to the body of the user. Referring to FIGS. 3 and 4, for instance, back part 18*a* would be molded with a curved contour for shoulder or back musculature. This is an area of the chair which could also be made of some flexible, resilient, mesh or other material that would conform to shape.

Figure 2:
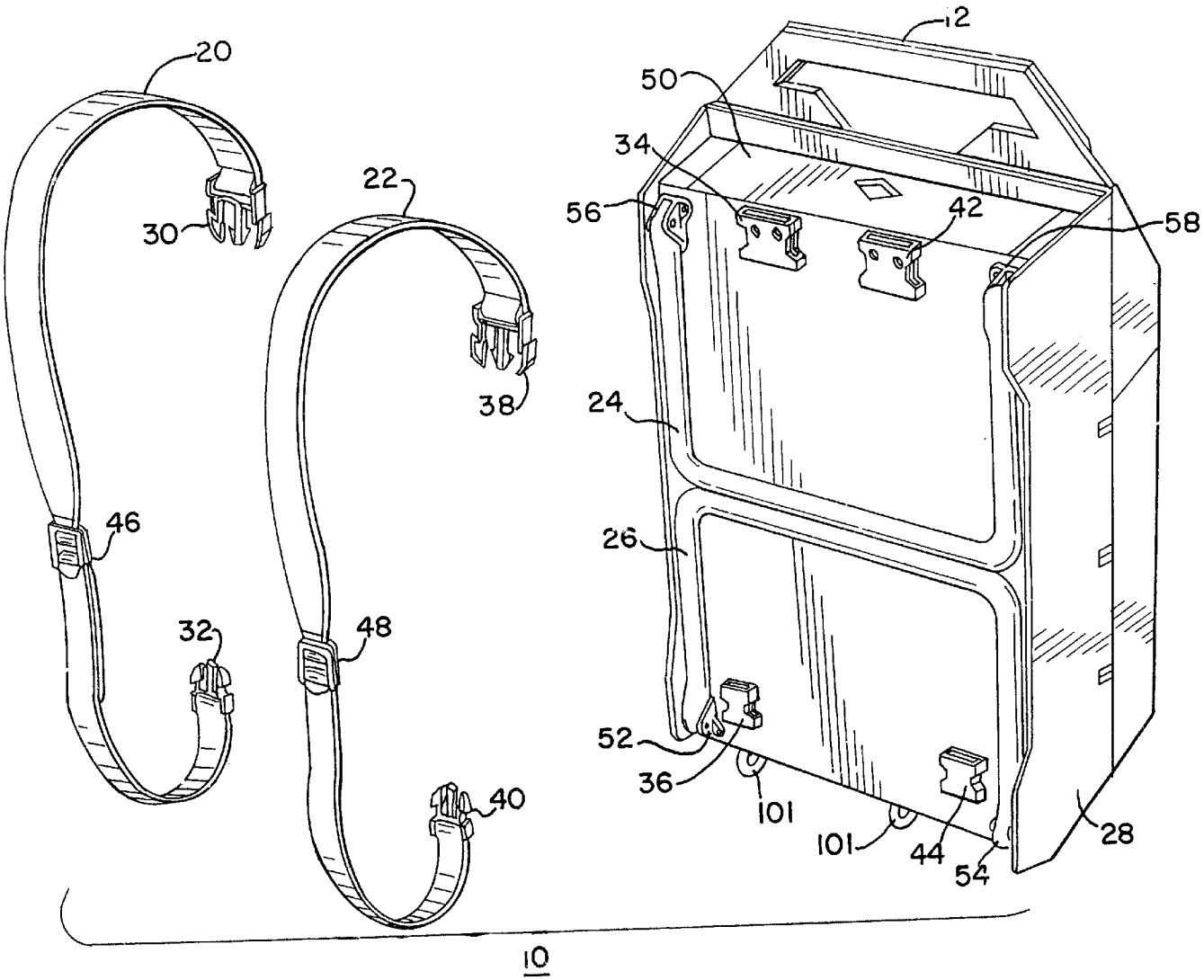
FIG. 2 shows one embodiment of a partially-exploded back perspective view, opposite from that shown in FIG. 1, of the multi-function transportable recreation chair of FIG. 1.

Referring to FIG. 2, chair 10 is illustrated from the opposite perspective than in FIG. 1. As shown in FIG. 2, chair 10 includes first strap 20, second strap 22, first leg stand portion 24, second leg stand portion 26 and seat portion 28. Chair 10 may also include wheels 101 disposed near the bottom end of seat portion 28, such as in a larger or heavier version of the illustrated embodiment.

First strap 20, which may be made of a standard backpack type nylon-based material that can provide a sturdy, comfortable fit, includes top male insert 30 and bottom male insert 32. Top male insert 30 is received in top female insert 34 on the bottom side of seat portion 28, as shown. Likewise, bottom male insert 32 is inserted into bottom female insert 36 on the bottom side of seat portion 28, as shown. In like manner, second strap 22 includes top male insert 38 and bottom male insert 40. Top male insert 38 is inserted into top female insert 42 on the bottom side of seat portion 28, and bottom male insert 40 is inserted into bottom female insert 44 on the bottom side of seat portion 28. These straps and their connectors are standard backpack issue. Both first strap 20 and second strap 22 may be adjusted in a well known arrangement via first adjuster 46 and second adjuster 48, to provide an adequate fit around the shoulder and upper body of the user.

First leg stand portion 24 and second leg stand portion 26 are fixably attached to seat portion 28 in a manner allowing for the repeated folding of these leg stand portions, such as, for example, through the use of hinges 52, 54, 56, 58. The leg stand portions 24, 26 are u-shaped tubular metal, pivoting via pins on the foregoing hinges. A stop is provided to the pivoting movement in the extended position of the leg stand portions (shown in FIGS. 3 and 4). This type of leg stand arrangement is well known.

Figure 2B:
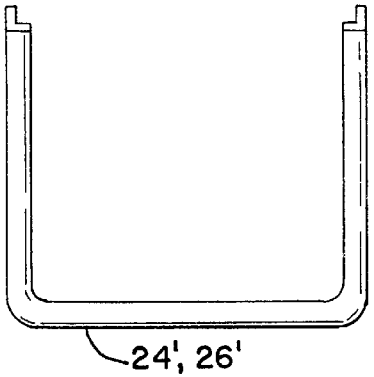
FIG. 2*b* shows a detail of one embodiment of the legs according to the present invention.
Figure 2A:
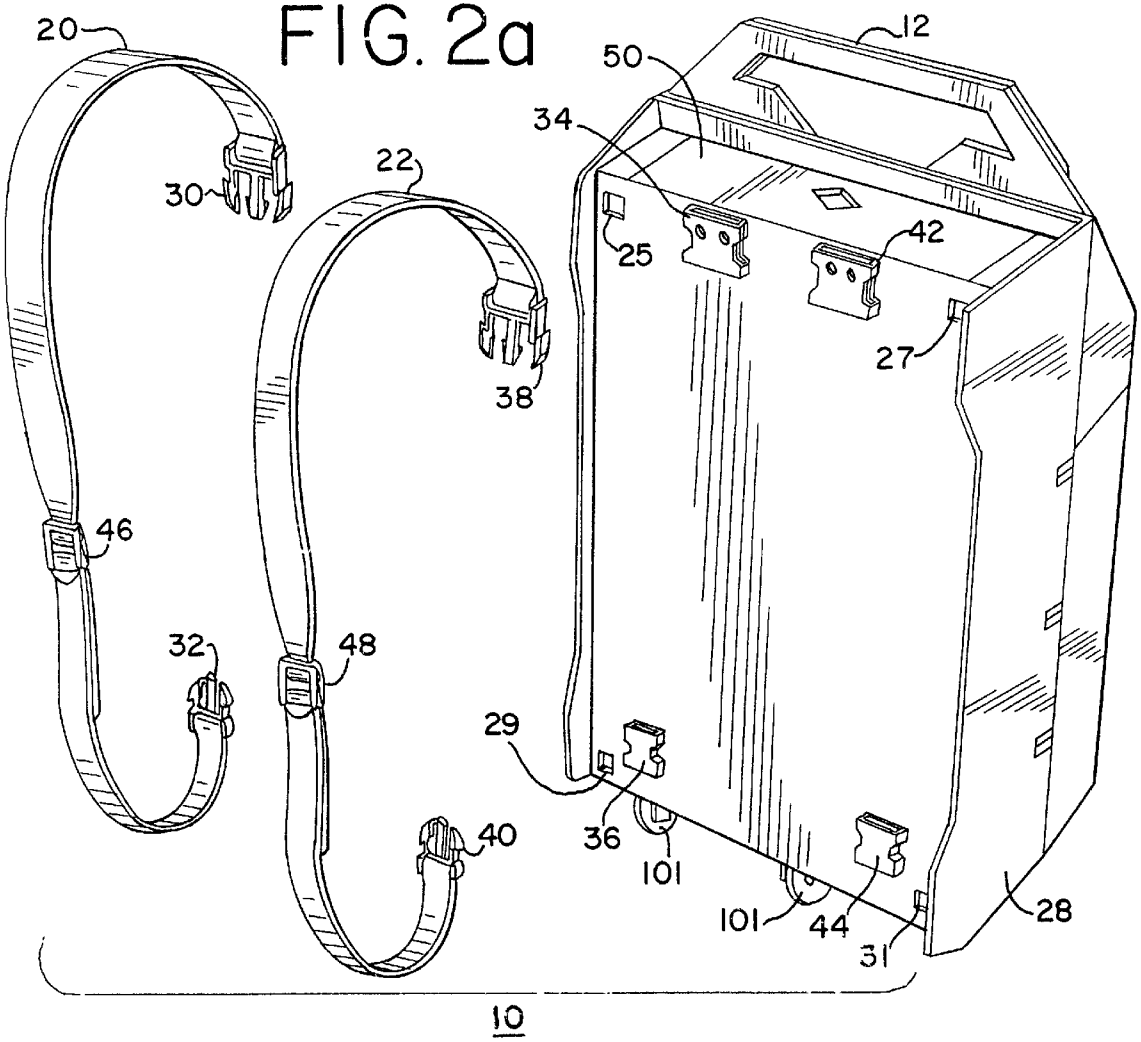
FIG. 2*a* shows a modified version of the FIG. 2 embodiment.

Alternatively, first leg stand portion 24 and second leg stand portion 26 may be fixably attached to seat portion 28 by means of a friction engagement grip, wherein seat portion 28 comprises female ends 25, 27, 29, 31 for receiving a version of male ended first leg stand portion 24' and second leg stand portion 26'. In such a case, first leg stand portion 24' and second leg stand portion 26' need not be tubular in shape, but L-shaped to fit within the female slots. An embodiment of this type of attachment alternative is shown in FIG. 2a and FIG. 2*b*.

Seat portion 28 (FIG. 4) may be constructed of moldable lightweight plastic, or any other similar lightweight material that provides for a comfortable seat for a user. Additionally, seat portion 28 may be contoured to fit to the body of the user, in the same manner described for the back portion 18.

Seat portion 28 includes first seat portion door 50 (FIG. 2). First seat portion door 50 is fixably attached to seat portion 28 in a manner allowing for repeated opening and closing of first seat portion door 50, such as, for example, through the use of hinges (not shown). First seat portion door 50 opens for access to a seat portion internal storage area (not shown). This internal storage area extends roughly the entire length and width of the seat portion 28, providing a fairly large storage container.

Referring to FIG. 3, chair 10 is illustrated in a partially open position. As shown in FIG. 3, chair 10 includes leg portion 78. Also, in FIG. 3, first armrest portion 14 and second armrest portion 16 have been unfolded from their position as shown in FIG. 1. Preferably, first armrest portion 14 and second armrest portion 16 may be movably attached to either back portion 18 or seat portion 28 in a manner allowing for repeated folding of first armrest portion 14 and second armrest portion 16, such as, for example, through the use of hinges, partially shown as 60, 62, 64, 66. The hinged arrangement for the armrests further includes stop positions in the fully-opened condition.

First armrest portion 14 and second armrest portion 16 also include first armrest portion container door 70 and second armrest portion container door 72. First armrest portion container door 70 and second armrest portion container door 72 are fixably attached to first armrest portion 14 and second armrest portion 16, respectively, in any manner allowing for repeated opening and closing of first armrest portion container door 70 and second armrest portion container door 72, such as, for example, through the use of hinges (not shown). First armrest portion container door 70 and second armrest portion container door 72 respectively open to first armrest portion container and second armrest portion container therein (not shown). First armrest portion container and second armrest portion container, similar to seat portion container, preferably extend nearly the entire length and width of the armrest portions, and may be used for storage.

Figures 4A, 4B, 5:
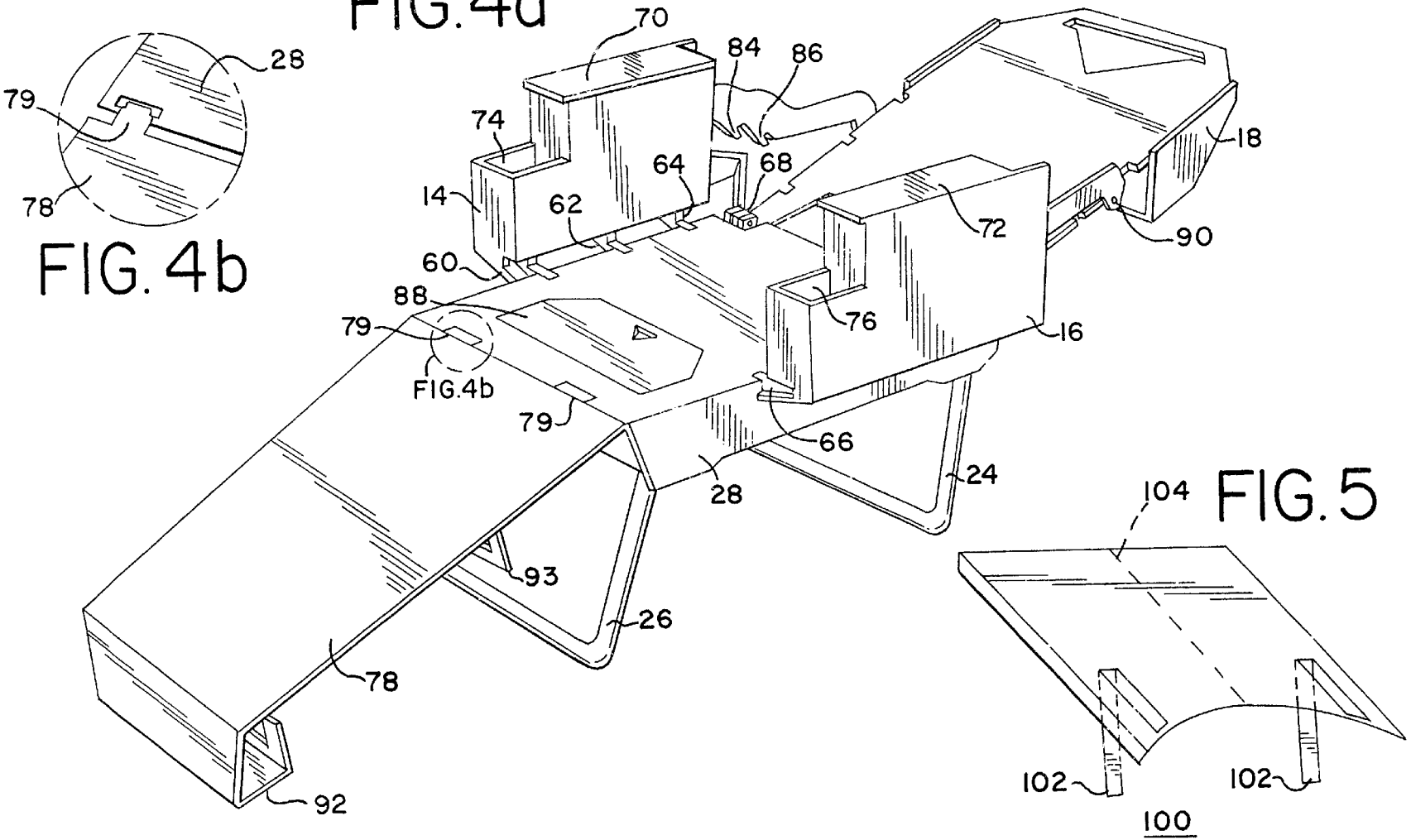

Additionally, first armrest portion container door 70 and second armrest portion container door 72 may include slots 71, 73 for receiving tray table 100 (described more fully with respect to FIG. 5).

Additionally, first armrest portion 14 and second armrest portion 16 also include third armrest portion container 74 and fourth armrest portion container 76. Similar to first armrest portion container and second armrest portion container, third armrest portion container 74 and fourth armrest portion container 76 are preferably hollow portions of first armrest portion 14 and second armrest portion 16, respectively, and may be used for storage (such as a cupholder).

Figures 3A, 3B:
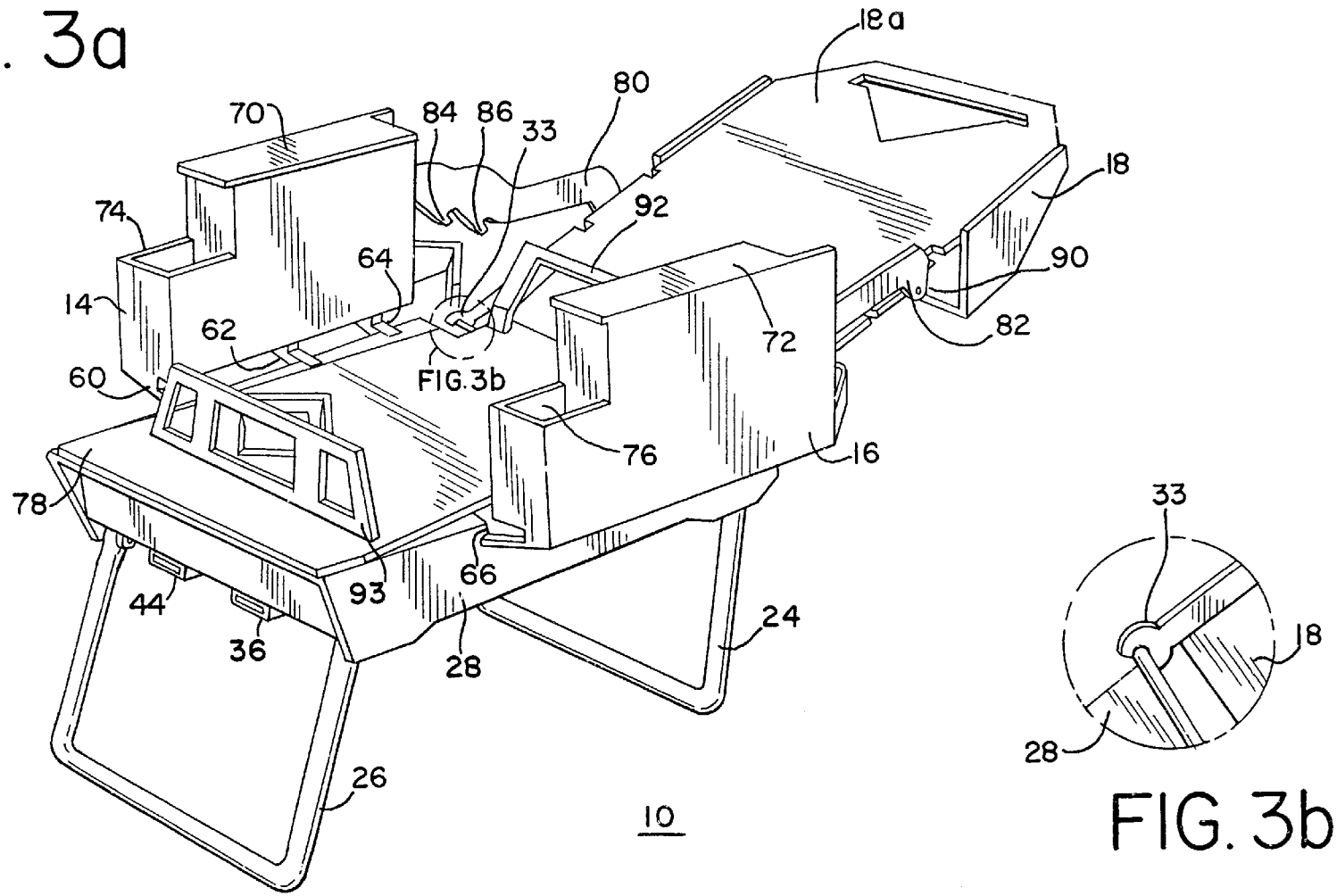
FIG. 3*a* shows a modified version of the FIG. 3 embodiment.
FIG. 3*b* shows a detail of one embodiment of the hinge shown in FIG. 3*a;*

Additionally as shown in FIG. 3, back portion 18 has been unfolded from its position as shown in FIG. 1. Back portion 18 is fixably attached to seat portion 28 in a manner allowing for repeated folding of back portion 18, such as, for example, through the use of hinges, partially shown as 68. Alternatively, back portion 18 may be fixably attached to seat portion 28 through the use of a snap swivel hinge 33, as shown in FIG. 3*b*.

Additionally shown in FIG. 3 are back portion supports 80, 82. Back portion supports 80, 82 are used to adjust the position of back portion 18 from seat portion 28, and releasably fix the back portion in position. Back portion supports 80, 82 are ratcheted in form, including teeth 84, 86, etc., on one end which engage in a lower lip of a slot (not shown) through which the supports 80, 82 extend from within first armrest portion 14 and second armrest portion 16, respectively. The supports 80, 82 are attached at the other end via pivot pins 90 to back portion 18.

FIG. 4 shows chair 10 in a fully open position. Leg portion 78 has been unfolded from its position as shown in FIG. 3. Preferably, leg portion 78 is fixably attached to seat portion 28 in any manner allowing for repeated folding of leg portion 78, such as, for example, through the use of one or more hinges (not shown in FIG. 4). Alternatively, leg portion 78 may be releasably attached to seat portion 28 through the use of swivel hook hinge mechanism 79, as shown in FIG. 4*b*. Leg portion foot support 92 is formed at the lower end of the leg portion 78, which rests upon the ground and gives some elevation to the leg portion at this end. Also provided is another leg portion support 93, best seen in FIG. 3. Leg portion 78 is advantageously adapted to be removably attached to seat portion 28, so that it can be used as a separate table, if so desired. In its table mode, leg portions 92 and 93 form the table's legs.

Also shown in FIG. 4 is second seat portion door 88. Second seat portion door 88 is hingedly attached to seat portion 28 in like manner to the doors previously described. As with first seat portion door 50, second seat portion door 88 opens to the seat portion interior storage area.

Additionally, chair 10 includes tray table 100, shown in FIG. 5. Tray table 100 may be stored in seat portion container. Tray table 100 is foldable (as shown by dashed line 104), and is releasably attached to chair 10 at the armrest portions, via connectors 102, and provides for a personal table for use by the user. Connectors 102, as shown in FIG. 5, may hinge up and down with respect to tray table 100.

Returning to FIG. 1, yet another storage compartment is provided, this time in the top of back portion 18. This storage area is accessed through door 17, which is hingedly connected along side 17*a* to the back portion via one or more hinges (not shown). This back portion storage area once again extends along roughly the entire internal extent of this part of the back portion.

It should be appreciated that the embodiments described above are to be considered in all respects only illustrative and not restrictive. The scope of the invention is indicated by the following claims rather than by the foregoing description. All changes that come within the meaning and range of equivalents are to be embraced within their scope.

What is claimed is:

1. A chair, comprising:

a seat portion including a seat portion top side, a seat portion bottom side, a seat portion top end, a seat portion bottom end, a first storage compartment defined therein, said first storage compartment including a first access point;

a back portion including a back portion top side and a back portion bottom side, said back portion operably attached to said seat portion;

a leg portion operably attached to said seat portion, said leg portion having a leg portion top side and a leg portion bottom side;

a first armrest portion operably attached to said seat portion, said first armrest portion having a first armrest portion first side and a first armrest portion second side and including a second storage compartment positioned therein;

a second armrest portion operably attached to said seat portion, said second armrest portion having a second armrest portion first side and a second armrest portion second side and including a third storage compartment positioned therein; and at least one carrying strap operably attached to one of said portions;

wherein said back portion top side folds to face said seat portion top side, said leg portion top side folds to face said seat portion top side, and said first armrest portion first side and said second armrest portion first side fold to face said leg portion bottom side, thereby yielding a portable chair adapted to be carried on the back of a user through the use of said at least one strap.

2. The chair of claim 1 further including a carrying handle attached to said back portion.

3. The chair of claim 1 further including wheels rotatably attached to one of said portions.

4. The chair of claim 1 wherein said back portion includes a fourth storage compartment positioned therein.

5. The chair of claim 1 wherein each of said portions is formed of a substantially rigid material.

6. The chair of claim 5 wherein said seat, back, and armrest portions are substantially boxlike and hollow.

7. The chair of claim 6 wherein in a carrying mode, said portions interlock to form a substantially rectangular-shaped device.

8. A portable chair, comprising;

a seat portion;

a back portion movably attached to said seat portion;

a first armrest and a second armrest movably attached to at least one of said seat portion and said back portion; and wherein each of said portions define a storage compartment therein; and said portions interlock in a transport mode to form a compact shaped substantially boxlike device.

9. The portable chair of claim 8 wherein each of said portions are substantially boxlike and hollow.

10. The portable chair of claim 8 further including a leg portion movably attached to said seat portion, said leg portion in an extended mode forming a chaise lounge as the portable chair.

11. The portable chair of claim 8 wherein said boxlike device is a backpack, including at least one strap adapted to be carried by a person, said at least one strap operably attached to said seat portion.

12. The portable chair of claim 8 wherein said boxlike device further includes at least one wheel rotatably attached to one of said portions and a handle attached to said back portion.

13. A portable chair, comprising;

a seat portion;

a back portion movably attached to said seat portion;

a leg portion movably attached to said seat portion, said leg portion in an extended mode forming a chaise lounge as the portable chair; wherein said portions interlock in a transport mode to form a compact shaped substantially boxlike device and wherein each of said seat and back portions are substantially boxlike and hollow.

14. The portable chair of claim 13 wherein said chair further includes armrest portions movably attached to one of said seat and back portions.

15. The portable chair of claim 14 wherein said armrest portions are substantially boxlike and hollow.

16. The portable chair of claim 15 wherein each of said seat, back and armrest portions define storage compartments therein.

17. The portable chair of claim 13 wherein said boxlike device is a backpack, including at least one strap adapted to be carried by a person, said at least one strap operably attached to said seat portion.

18. The portable chair of claim 13 wherein said boxlike device further includes at least one wheel rotatably attached to one of said portions and a handle attached to said back portion.

* * * * *